US007471769B2

(12) United States Patent
Harding et al.

(10) Patent No.: US 7,471,769 B2
(45) **Date of Patent: *Dec. 30, 2008**

(54) X-RAY SOURCE PROVIDED WITH A LIQUID METAL TARGET

(75) Inventors: Geoffrey Harding, Hamburg (DE); Bernd David, Huettblek (DE); Rainer Willi Eckart, Hamburg (DE); Jens Peter Schlomka, Hamburg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 264 days.

This patent is subject to a terminal disclaimer.

(21) Appl. No.: 10/481,802

(22) PCT Filed: Jun. 20, 2002

(86) PCT No.: PCT/IB02/02374

§ 371 (c)(1),
(2), (4) Date: Dec. 22, 2003

(87) PCT Pub. No.: WO03/001556

PCT Pub. Date: Jan. 3, 2003

(65) Prior Publication Data

US 2004/0174957 A1 Sep. 9, 2004

(30) Foreign Application Priority Data

Jun. 21, 2001 (DE) ..... 101 30 070

(51) Int. Cl.
*H01J 35/08* (2006.01)
*H01J 35/00* (2006.01)

(52) U.S. Cl. ..... 378/143; 378/119

(58) Field of Classification Search ..... 378/119, 378/143, 121, 130, 141; 137/7, 9, 12, 87.04, 137/565.13; 417/28, 31, 44.2, 44.4–44.9
See application file for complete search history.

(56) References Cited

U.S. PATENT DOCUMENTS 6,185,277 B1 * 2/2001 Harding ..... 378/143
6,477,234 B2 * 11/2002 Harding et al. ..... 378/141
6,560,313 B1 * 5/2003 Harding et al. ..... 378/143
6,580,781 B2 * 6/2003 Bachmann et al. ..... 378/161
6,625,254 B2 * 9/2003 Bachmann et al. ..... 378/161
6,647,094 B2 * 11/2003 Harding et al. ..... 378/143

(Continued)

FOREIGN PATENT DOCUMENTS

DE 27 19 609 A1 11/1978

(Continued)

*Primary Examiner*—Edward J Glick
*Assistant Examiner*—Anastasia Midkiff

(57) ABSTRACT

An X-ray source and an X-ray apparatus with an X-ray source are provided, the X-ray source includes a liquid metal target which flows through a system of ducts and is conducted through a duct section which has a flow cross-section that is reduced relative to that of the system of ducts. The X-ray source provides a pressure source for acting on the liquid metal target such that the pressure in the liquid metal target at the area of the reduced flow cross-section equals essentially a selectable reference value or remains essentially in a pressure range between selectable limit values of the pressure. A comparatively small thickness of a window can thus be realized in conjunction with a comparatively high flow speed.

9 Claims, 3 Drawing Sheets

U.S. PATENT DOCUMENTS 6,925,151 B2 * 8/2005 Harding et al. ..... 378/119

FOREIGN PATENT DOCUMENTS

DE 19955392 A1 * 5/2001
EP 0 432 568 A2 6/1991
EP 0 584 871 A1 3/1994
WO WO 03/107297 A2 * 12/2003

* cited by examiner

X-RAY SOURCE PROVIDED WITH A LIQUID METAL TARGET

BACKGROUND

The invention relates to an X-ray source which is provided with a liquid metal target which flows through a system of ducts and is conducted through a duct section whose flow cross-section is reduced relative to that of the system of ducts. The invention also relates to an X-ray apparatus provided with such an X-ray source.

An X-ray source of this kind is known from DE 198 21 939.3. At the area of the reduced flow cross-section therein there is arranged a window, for example, of diamond, which is transparent to electrons and wherethrough high energy electrons (≈150 keV) can be directed into the liquid metal target so as to excite X-ray bremsstrahlung therein.

The aim is to construct the electron window to be as thin as possible (≈1-3 μm) so as to minimize the absorption of electrons and X-rays in the window (and hence also the heating thereof) and to achieve a high power of the X-ray source. The reduction of the cross-section results in a turbulent flow of the liquid metal target at the area of the window, said turbulent flow ensuring cooling of the window and a very effective dissipation of heat, so that the power density and the continuous loadability of the X-ray source can be further increased.

However, because the window separates the liquid metal target from a vacuum chamber, it must also have a minimum thickness which is so large that the reliability of operation, notably adequate pressure strength, is ensured in all realistic operating conditions. Optimization of the window in respect of an as small as possible thickness while providing at the same time adequate strength is particularly difficult notably because the turbulent flow involves the risk of formation of cavitations which are capable of exerting substantial forces on the window and the surrounding parts, for example, when the flow speed is unintentionally increased or the reduction of the flow cross-section becomes excessive because of the presence of foreign matter or manufacturing tolerances.

SUMMARY

Therefore, it is an object of the invention to provide an X-ray source of the kind set forth in which the minimum thickness of the window can be further reduced without affecting the reliability of operation of the X-ray source.

It is also an object to provide an X-ray source of the kind set forth in which the cooling of the window can be further enhanced by a turbulence in the liquid metal flow.

This object is achieved by means of an X-ray source which is provided with a liquid metal target which flows through a system of ducts and is conducted through a duct section whose flow cross-section is reduced relative to that of the system of ducts, characterized in that there is provided a pressure source for acting on the liquid metal target in such a manner that in the operating condition of the X-ray source the pressure in the liquid metal target at the area of the reduced flow cross-section equals essentially a selectable reference value or remains essentially in a pressure range between selectable limit values of the pressure.

A special advantage of this solution resides in the fact that on the one hand the flow speed of the liquid metal target, and hence the cooling of the window, can thus be further increased without having to accept the risk of cavitations, necessitating an increased thickness of the window, because it can be ensured by the pressure source at least that the pressure will not drop below a selectable minimum pressure and that, moreover, a selectable maximum pressure is not exceeded either, if desired.

Other embodiments relate to advantageous further embodiments of the invention.

In one embodiment in conformity with one aspect of the invention the liquid metal target can be subject either to a non-controlled, that is, essentially constant, additional pressure which also increases the pressure at the area of the reduced flow cross-section accordingly, thus preventing the occurrence of cavitations at that area, or pressure self-control is realized, that is, notably in a further version of this embodiment, without sensors and separate control devices or the like being required.

The liquid metal target can be subjected to a controlled pressure notably in other embodiments disclosed herein so that the pressure at the area of the reduced flow cross-section cannot increase excessively, not even when, for example, the flow speed decreases (external pressure control).

In this case the liquid metal target is preferably subjected in conformity with another aspect of an embodiment of the invention.

DRAWINGS

Further details, features and advantages of the invention will become apparent from the following description of preferred embodiments which is given with reference to the drawing. Therein:

DESCRIPTION

Figure 1:
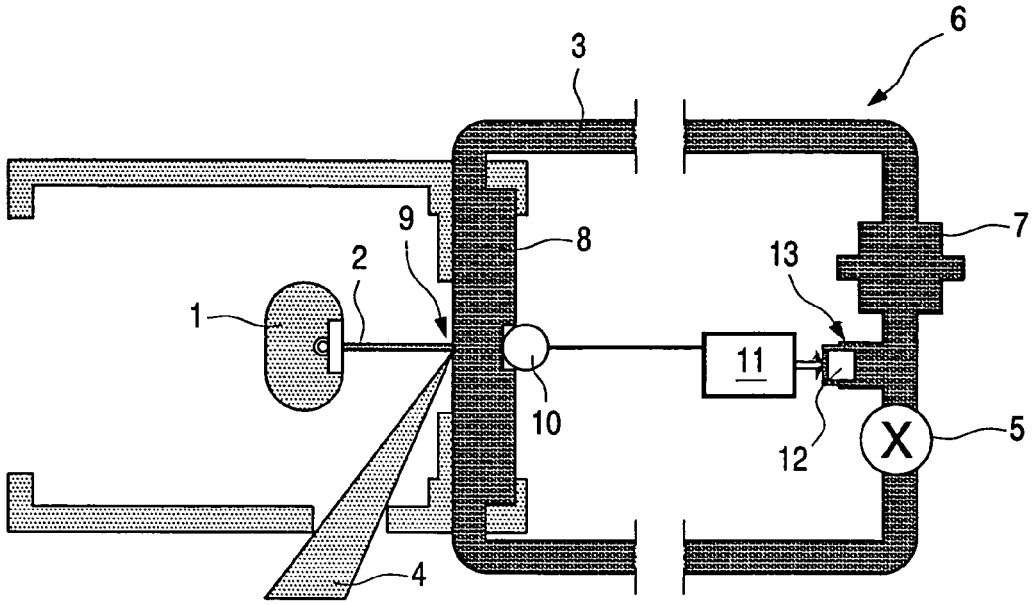
FIG. 1 is a diagrammatic representation of a first embodiment of the invention.

FIG. 1 shows the parts of a first embodiment of an X-ray source provided with a liquid metal target which are of relevance in the context of the present invention. An electron beam source 1 (cathode) serves to generate an electron beam 2 which is directed onto a liquid metal target 3 (anode). The X-rays thus produced emanate from the X-ray source.

The liquid metal target 3 is pumped through a system of ducts 6 by means of a pump 5 and also traverses a heat exchanger 7 for the dissipation of heat from the target.

The system of ducts 6 also feeds a duct section 8 which includes a window 9 which is transparent to electrons and X-rays and also has a flow cross-section which has been reduced relative to that of the system of ducts, so that a turbulent flow occurs in the liquid metal target at the area of the window.

The electron beam 2 is aimed at the window 9 and enters the liquid metal target 3 via said window, thus generating the X-rays 4.

The window has an as small as possible thickness (approximately 1-3 μm), so that the electron beam and the X-rays can traverse the window substantially without incurring absorption losses and hence without the associated significant heating of the window.

An as fast and as strong as possible turbulent flow of the liquid metal target 3 at the area of the window 9 also provides suitable cooling of the window, so that the power density can be further increased.

For suitable proportioning of the thickness of the window, the following pressure and speed conditions of the flow at the area of the cross-sectional restriction must be taken into account.

Ignoring other types of energy (frictional losses, force of gravity etc.), conformity with Bernoulli's law the pressure $P_c$ in the liquid flowing into the cross-sectional restriction at the speed vc must be lower than the pressure Pi at which the liquid flows at the speed restriction:

$$P_1-P_c=P_{Bernoulli}=\rho/2(v_c^2-v_1^2).$$

Therein, $P_1$ and $P_c$ denote the respective static pressure and ρ is the density of the liquid. The product of ρ/2 and $v_c$ is also known as the dynamic pressure.

The ratio of the speeds $v_1$ and $v_c$ also represents the ratio of the surface area of the constricted cross-section and the surface area of the cross-section outside the constriction. This ratio of the cross-sections can be chosen at random. The smaller the cross-sectional area of the constriction, the higher the flow speed $v_c$ of the liquid metal target will be at that area. In conjunction with the comparatively high density of liquid metals, a substantial pressure reduction is thus obtained on the window 9, so that the window may be constructed so as to be comparatively thin.

The above formulas, however, also demonstrate that for a correspondingly small ratio of the cross-sections the pressure in the cross-sectional constriction can in theory approach zero, or at least become so small that the vapor pressure of the liquid is reached. This may give rise to cavitations, that is, the formation of cavities in the constriction and to destruction of the window 9, of the duct section 8 or of other mechanical components in the liquid metal circuit.

In order to avoid destruction or damaging of the window 9 in the case of a very small thickness and a small cross-sectional ratio, therefore, the pressure $P_c$ on the window may neither drop below a minimum (first) value $P_{s1}$ nor exceed a maximum (second) value $P_{s2}$.

When a pressure $P_1$ outside the cross-sectional constriction of approximately 80 bar is assumed in a practical embodiment, the pressure $\Delta P_{Bernoulli}$ should be $<P_1$ and notably the pressure $P_c$ on the window at least should not drop below a first minimum first value $P_{s1}$ of approximately from 1 to 2 bar.

In order to satisfy the above conditions, a pressure sensor 10 which is known per se is provided so as to measure the actual value of the pressure $P_c$ on the window 9, said pressure sensor being connected to an electronic pressure control device 11 (servo circuit). Depending on the output signal of the sensor 10, the control device 11 controls and actuates a piston 12 which, via a cylinder 13 which is connected to the system of ducts 6, subjects the liquid metal target to an additional static pressure $P_g$. The pressure $P_g$ is preferably controlled in such a manner that, when the actual value of the pressure $P_c$ on the window decreases to or below the minimum value $P_{s1}$, the static pressure $P_g$ is increased whereas, when the actual value of the pressure $P_c$ on the window increases to or beyond the maximum value $P_{s2}$, the static pressure $P_g$ is reduced accordingly.

The two values $P_{s1}$ and $P_{s2}$ may also be equal. Such a value $P_s$ is then selected as the reference value for the pressure, that is, preferably in such a manner that it is clearly below the maximum pressure at which the window would be damaged or destroyed but at the same time high enough to avoid all cavitations.

Instead of the piston/cylinder system 12, 13 shown, for example, a pressurized gas volume which is present in a vessel and can be electromechanically compressed and expanded (for example, by way of piezoelectric elements) can also be used as a pressure source. Because the compressibility of liquids is comparatively small, a small change of the liquid volume can already result in a large pressure variation. When a relative volume variation dV/V of a constant quantity of liquid is related to its relative pressure variation dP/P, a value of approximately $10^{-3}$ is obtained for (dV/V)/(dP/P).

Figure 2:
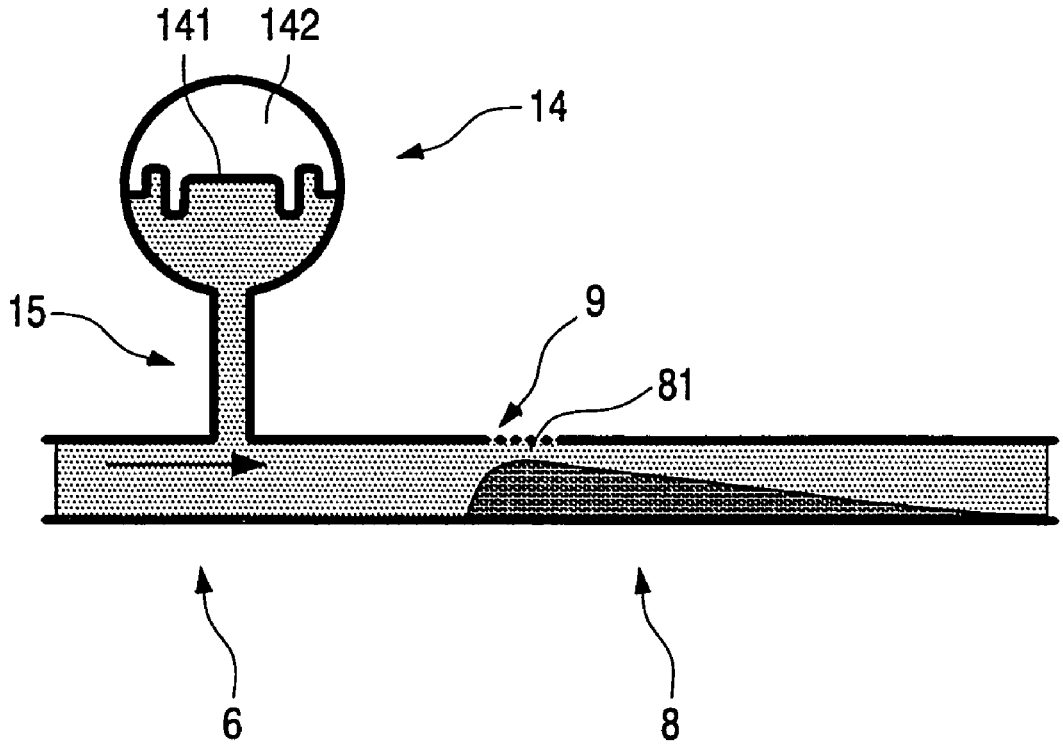
FIG. 2 is a detailed representation of a part of a second embodiment.

FIG. 2 shows a second, simplified embodiment, only the duct section 8 with the cross-sectional constriction 81 and the window 9 as well as a part of the system of ducts 6 which adjoins the duct section being shown therein. In this embodiment a vessel 14 is provided as the pressure source, which vessel is provided with a liquid coupling to the system of ducts 6 via a connection duct 15. The vessel 14 is provided with a diaphragm 141 which separates the liquid from a pressurized gas volume 142. The gas volume subjects the liquid in the entire system of ducts to an essentially constant, non-controlled, additional static pressure $P_g$ which also increases the pressure in the reduced flow cross-section and is chosen to be such that the pressure $P_c$ on the window does not drop below the minimum value $P_{s1}$ which involves the risk of cavitations, that is, not even in the case of an increasing flow speed of the liquid metal target.

It may again be advantageous to control the static pressure $P_g$ in the gas volume 142, for example, by means of a servo circuit. This circuit is supplied with the pressure $P_c$ measured on the window by means of a known pressure sensor, as well as with a selected, safe operating pressure $P_s$ which acts as the reference value. The static pressure $P_g$ is then controlled in such a manner that it is increased accordingly when the pressure $P_c$ on the window drops below the reference value $P_s$ and is reduced accordingly when the pressure $P_c$ on the window exceeds the reference value $P_s$ (or leaves the range between the two above limit values $P_{s1}$ and $P_{s2}$). The change of the static pressure $P_g$ in the gas volume can then be realized, for example, again by influencing the vessel 14 by means of piezoelectric elements or in a different manner.

Figure 3:
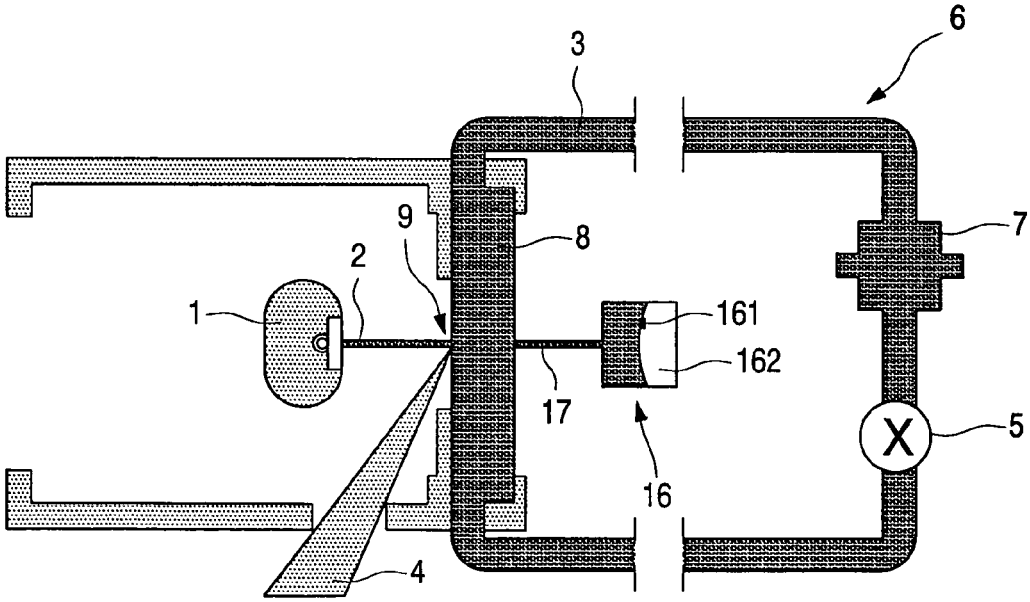
FIG. 3 is a diagrammatic representation of a third embodiment of the invention.

FIG. 3 shows a third embodiment of the invention; parts therein which correspond to FIG. 1 are denoted by the same reference numerals and hence need not be elucidated again.

Like the second embodiment shown in FIG. 2, this embodiment includes a vessel 16 with a liquid coupling, via a connection duct 17, to the duct section 8. The vessel is provided with a diaphragm 161 which separates the liquid from a gas volume 162 with an essentially constant, selectable pressure. The connection duct 17 opens into the duct section 8 in a location which is situated essentially opposite the window 9.

For as long as the pump 5 is inactive, the pressure in the gas volume 162 propagates, like in the second embodiment, as a static pressure through the entire liquid circuit, as in the second embodiment. When the pump is activated and the flow increases, the pressure in the cross-sectional constriction of the duct section 8 decreases for the above reasons, and hence also the pressure on the window 9 which is situated in this area. Consequently, liquid is drawn from the vessel 16, via the connection duct 17, and enters the circuit. Because of this additional amount of liquid, a comparatively strong increase of the static pressure occurs in the system of ducts 6 as well as in the duct section 8. A very small inflow or return to the vessel 16 already suffices to keep the pressure $P_c$ at the area of the cross-sectional constriction at a desired reference value $P_s$ or between the two above-mentioned limit values $P_{s1}$ and $P_{s2}$.

Pressure self-control is thus realized, the gas pressure in the vessel 16 being chosen in dependence on the cross-sectional and pressure ratios in the system of ducts in such a manner that the reference value, or the above limit values, are adhered to. The circuit preferably does not include any further pressure equalization vessels. The more rigid the system of ducts 6 and the duct section 8, the smaller the amount of liquid which is actually exchanged between the vessel 16 and the circuit will be.

An essential advantage of this embodiment resides in the fact that on the one hand no sensors, no electronic control circuitry and no hydraulic system or the like are required for controlling an external pressure source, while on the other hand the operation of the self-control system is very fast.

The principle of the invention can thus be implemented in very different ways in dependence on the desired accuracy and the relevant application. Whereas the simplest embodiment as shown in FIG. 2 can be realized without pressure control, automatic pressure self-control takes place in the embodiment shown in FIG. 3 whereas external pressure control by means of a sensor and a corresponding control device takes place in the embodiment shown in FIG. 1.

The X-ray source in accordance with the invention can thus be used in a wide variety of different X-ray devices.

Figure 4:
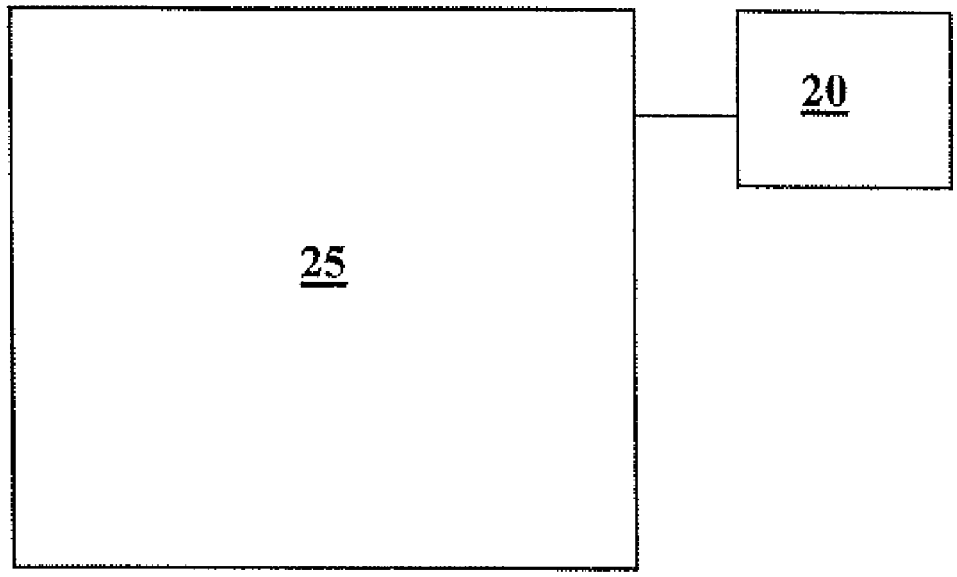
FIG. 4 illustrates an apparatus that includes an X-ray source, such as shown in FIGS. 1-3.

FIG. 4 illustrates an apparatus 25 that includes an X-ray source 20, such as embodied in FIGS. 1-3 of this application.

The invention claimed is:

1. An X-ray source comprising:

a liquid metal target which flows through a system of ducts which includes a duct section whose flow cross-section is reduced relative to that of the remainder of the system of ducts;

a device for pumping the liquid metal target through the system of ducts;

a pressure source acting on the liquid metal target;

a pressure control device to control the pressure of the liquid metal target at the area of the reduced flow cross-section;

a device different from the pumping device, which constrains the pressure of the liquid metal target at the area of the reduced flow cross-section to remain essentially in a pressure range between selectable limit values of the pressure; and a sensor for measuring a pressure in the liquid metal target at the area of the reduced flow cross-section, the output signal of said sensor being suitable to control the pressure source.

2. An apparatus comprising:

an electron beam source which generates an electron beam;

a liquid metal target towards which the electron beam is directed;

a duct system through which the liquid metal target flows, said duct system including a section of reduced cross-sectional flow;

a device for pumping the liquid metal target through the duct system;

a pressure source acting on said liquid metal target;

a sensor that measures a pressure in the liquid metal target at the area of the reduced flow cross-section, the output signal of said sensor being suitable to control the pressure source; and a pressure control device that controls the pressure of the liquid metal target at the area of the reduced flow cross-section such that the pressure of the liquid metal target at the area of the reduced flow cross-section remains essentially in a pressure range between selectable limit values of the pressure.

3. The apparatus of claim 2 wherein the pressure of the liquid metal target at the area of the reduced flow cross-section equals essentially a selectable reference value.

4. The apparatus of claim 2, wherein the pressure source is formed by a piston/cylinder system which acts on the liquid metal target.

5. The apparatus as claimed in claim 2, wherein the pressure source is formed by a vessel with a supply of liquid as well as by a pressurized gas volume which are separated from one another by a diaphragm, the supply of liquid communicating with the liquid metal target via a liquid coupling through a connection duct.

6. The apparatus of claim 5, further including a mechanism for adjusting a pressure of the pressurized gas to adjust the pressure range.

7. The apparatus of claim 6, wherein the pressure source includes a piston/cylinder system which acts to adjust a volume of the vessel to adjust the pressure range.

8. An X-ray source comprising:

a liquid metal target which flows through a system of ducts which includes a duct section whose flow cross-section is reduced relative to that of the remainder of the system of ducts;

a device for pumping the liquid metal target through the system of ducts;

a pressure source acting on the liquid metal target;

a pressure control device to control the pressure of the liquid metal target at the area of the reduced flow cross-section; and a sensor that measures a pressure in the liquid metal target at the area of the reduced flow cross-section, the output signal of the sensor being communicated to the pressure source to control the pressure.

9. The X-ray source of claim 8, further including:

means for controlling the pressure in a range between selectable pressure limits; and means for selecting the pressure limits.

* * * * *